US006872146B1

(12) United States Patent
Paesang et al.

(10) Patent No.: US 6,872,146 B1
(45) Date of Patent: Mar. 29, 2005

(54) JUVENILE SWING APPARATUS HAVING MOTORIZED DRIVE ASSEMBLY

(75) Inventors: Chinawut P. Paesang, Cumberland, RI (US); Jeff Pemberton, Plainville, MA (US)

(73) Assignee: Cosco Management, Inc., Wilmington, DE (US)

( * ) Notice: Subject to any disclaimer, the term of this patent is extended or adjusted under 35 U.S.C. 154(b) by 2 days.

(21) Appl. No.: 10/427,363

(22) Filed: May 1, 2003

(51) Int. Cl.[7] ..... A63G 9/16
(52) U.S. Cl. ..... 472/119
(58) Field of Search ..... 472/118–125; 297/273

(56) References Cited

U.S. PATENT DOCUMENTS

| | | | | |
|---|---|---|---|---|
| 3,842,450 | A | | 10/1974 | Pad |
| 4,150,820 | A | | 4/1979 | Bochmann |
| 4,448,410 | A | | 5/1984 | Kosoff |
| 4,452,446 | A | | 6/1984 | Saint |
| 4,491,317 | A | | 1/1985 | Bansal |
| 4,616,824 | A | | 10/1986 | Quinlan, Jr. et al. |
| 4,722,521 | A | | 2/1988 | Hyde et al. |
| 4,785,678 | A | | 11/1988 | McGugan et al. |
| 4,911,429 | A | | 3/1990 | Ogbu |
| 5,139,462 | A | | 8/1992 | Gabe |
| 5,326,327 | A | | 7/1994 | Stephens et al. |
| 5,376,053 | A | | 12/1994 | Ponder et al. |
| 5,525,113 | A | | 6/1996 | Mitchell et al. |
| 5,769,727 | A | | 6/1998 | Fair et al. |
| 5,833,545 | A | | 11/1998 | Pinch et al. |
| 5,846,136 | A | | 12/1998 | Wu |
| 5,975,631 | A | | 11/1999 | Fair et al. |
| 5,984,791 | A | | 11/1999 | Fair et al. |
| 6,022,277 | A | | 2/2000 | Jankowski |
| 6,059,667 | A | | 5/2000 | Pinch |
| 6,068,566 | A | | 5/2000 | Kim |
| 6,319,138 | B1 | | 11/2001 | Fair et al. |
| 6,339,304 | B1 | | 1/2002 | Allison et al. |
| 6,386,986 | B1 | | 5/2002 | Sonner et al. |
| 6,421,901 | B2 | | 7/2002 | Sitarski et al. |
| 6,471,597 | B1 | | 10/2002 | Flannery et al. |
| 6,511,123 | B1 | | 1/2003 | Sitarski et al. |
| 6,544,128 | B1 | * | 4/2003 | Yang ..... 472/119 |
| 6,626,766 | B1 | * | 9/2003 | Hsia ..... 472/119 |
| 2002/0052245 | A1 | | 5/2002 | Flannery et al. |

* cited by examiner

*Primary Examiner*—K. T. Nguyen
(74) *Attorney, Agent, or Firm*—Barnes & Thornburg LLP

(57) ABSTRACT

A swing apparatus comprises a support stand, a swing supported with respect to the support stand to oscillate back and forth along a swing arc about a pivot axis, and a drive assembly that operates to oscillate the swing. Various components of the drive assembly are coupled to the swing to oscillate therewith about the pivot axis. The drive assembly has a drive member that periodically engages a portion of the support stand resulting in a force being imparted on the swing to move the swing.

20 Claims, 13 Drawing Sheets

JUVENILE SWING APPARATUS HAVING MOTORIZED DRIVE ASSEMBLY

BACKGROUND

The present disclosure relates to juvenile swings, and particularly, to a juvenile swing apparatus having a motorized drive assembly. More particularly, the present disclosure relates to a juvenile swing apparatus having a motorized drive assembly that operates to oscillate a seat of the apparatus back and forth along a swing arc.

A conventional juvenile swing apparatus typically has a seat suspended from a floor-supported stand by one or more hanger arms. These conventional juvenile swing assemblies usually comprise some sort of drive mechanism to move the seat and hanger arms back and forth along a swing arc in an oscillatory manner. Juvenile swings sometimes comprise a lost-motion connection between the drive mechanism and the hanger arm so that, if the hanger arm and seat are prevented from swinging, either intentionally or unintentionally, the drive mechanism can continue to operate without damaging components of the juvenile swing. Motorized swings that are powered, in some instances by batteries, have become more popular in recent times. These motorized swings sometimes have motors with adjustable speeds to permit a user to change the frequency of the swinging motion of the seat.

SUMMARY

According to the present disclosure, a swing apparatus comprises a support stand, a swing supported with respect to the support stand to oscillate back and forth along a swing arc, and a drive assembly that operates to oscillate the swing relative to the support stand. The drive assembly has a driver mounted to the hanger arm to oscillate therewith. The drive assembly also has a drive member that is driven by the driver and that periodically engages a portion of the support stand resulting in a force being imparted on the hanger arm to move the swing.

In an illustrative embodiment, the support stand comprises a set of frame members and a pair of housings coupled to the upper ends of associated frame members. The drive assembly is situated in an interior region of one of the housings. The illustrative hanger arm that is driven by the drive assembly has a mounting portion to which an electric motor of the drive assembly is coupled. The mounting portion, along with the rest of the hanger arm and the motor, oscillates about a pivot axis during operation of the swing assembly. The illustrative drive assembly further includes a drive train that transmits motion from the driver to the drive member. In the illustrative embodiment, the drive train comprises a worm mounted on an output shaft of the motor, a worm wheel rotatably coupled to the mounting portion of the hanger arm and meshed with the worm, a pivot link that pivots about the same pivot axis that the hanger arm pivots about, and a connector link that interconnects the worm wheel with the pivot link.

Also in the illustrative embodiment, the drive member that engages the support stand to move the hanger arm is coupled to the pivot link and extends therefrom. The drive member may comprise a flexible element, such as a zigzag spring. As the pivot link pivots about the pivot axis, a free end region of the drive member periodically comes into contact with a portion of the associated housing of the support stand to flex the drive element and impart a force on the hanger arm. The pivoting of the pivot link about the pivot axis is out of phase with the pivoting of the hanger arm and seat about the pivot axis. Thus, the pivot link and hanger arm are sometimes pivoting in opposite directions about the pivot axis and are sometimes pivoting in the same direction about the pivot axis.

In some embodiments, the speed at which the motor rotates the output shaft is adjustable, thereby to adjust the frequency at which the drive member periodically engages the support stand. In the illustrative embodiment, the motor is operable at three different speeds. Thus, the frequency of oscillation of the hanger arm and the seat coupled thereto is sped up or slowed down by adjusting the speed of the motor. The hanger arm and seat naturally reach a resonant frequency depending upon the speed of the motor and the amount of weight being oscillated. In order to reach the resonant frequency of oscillation, the swing amplitude typically will change as the motor speed changes or as the amount of weight being oscillated changes.

Additional features and advantages of the disclosure will become apparent to those skilled in the art upon consideration of the following detailed description of an illustrative embodiment exemplifying the best mode of carrying out the disclosure as presently perceived.

BRIEF DESCRIPTION OF THE DRAWINGS

The detailed description particularly refers to the accompanying figures in which.

DETAILED DESCRIPTION OF THE DRAWINGS

Figure 1:
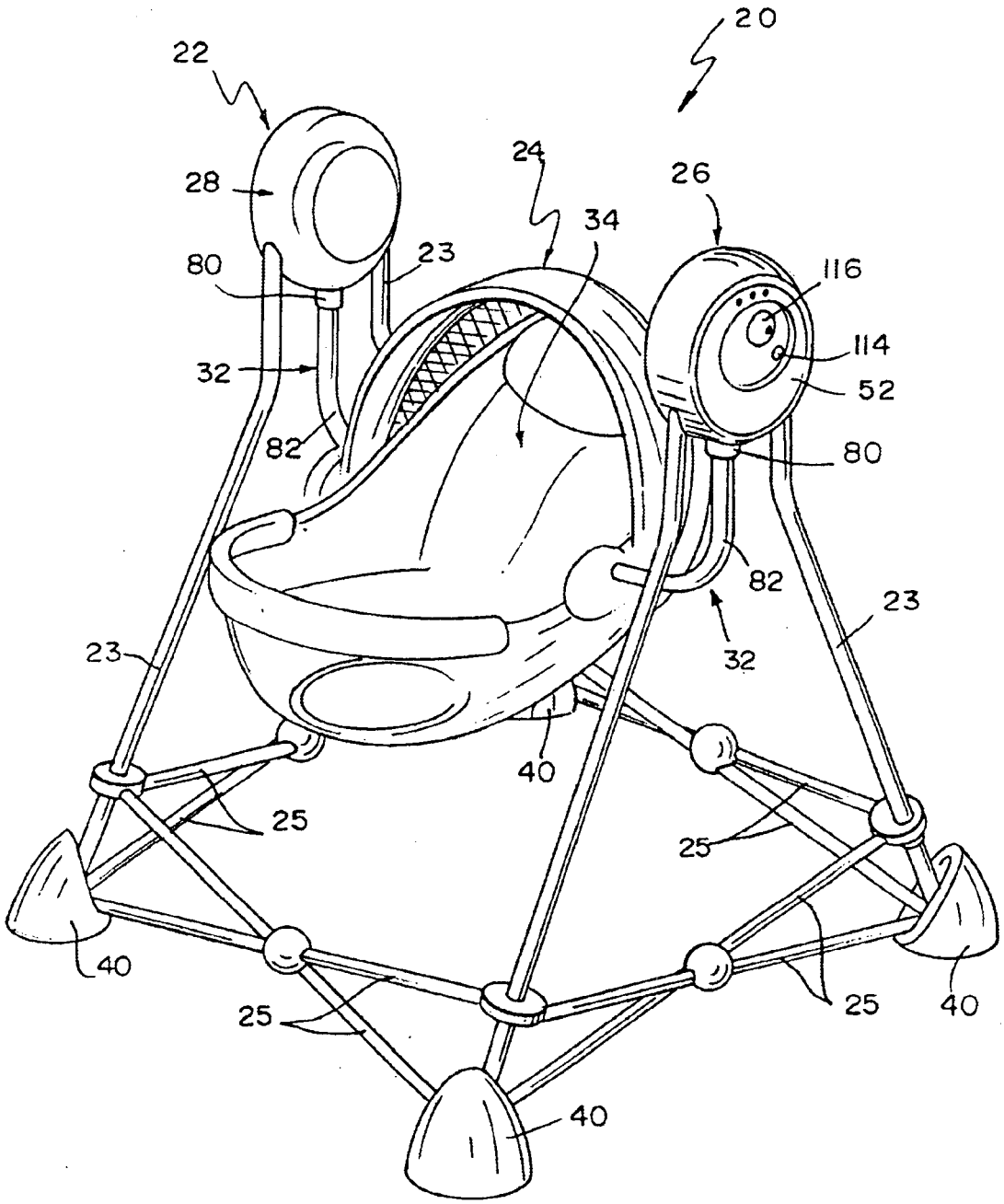
FIG. 1 is a perspective view of a juvenile swing apparatus in accordance with this disclosure showing a swing suspended with respect to a support stand and the swing comprising a seat and a pair of hanger arms.

A swing apparatus 20 comprises a support stand 22 and a swing 24 suspended for swinging movement with respect to stand 22 as shown in FIG. 1. Illustrative stand 22 comprises a set of main struts or frame members 23 and a set of cross struts or frame members 25. Stand 22 further comprises a first housing 26 coupled to upper end portions of two of struts 23 on one side of swing apparatus 20 and a second housing 28 coupled to upper end potions of another two struts 23 on the other side of swing apparatus 20 as shown in FIG. 1. Stand 22 comprises four floor-engaging feet 40 as shown in FIG. 1. Each foot 40 has coupled thereto the lower end of a respective main strut 23 and the lower ends of two respective cross struts 25. Struts 25 are grouped in pairs that form an X-configuration which extends between associated pairs of struts 23. In some embodiments, stand 22 is foldable between an expanded use position, shown in FIG. 1, and a compact storage position (not shown).

Figure 2:
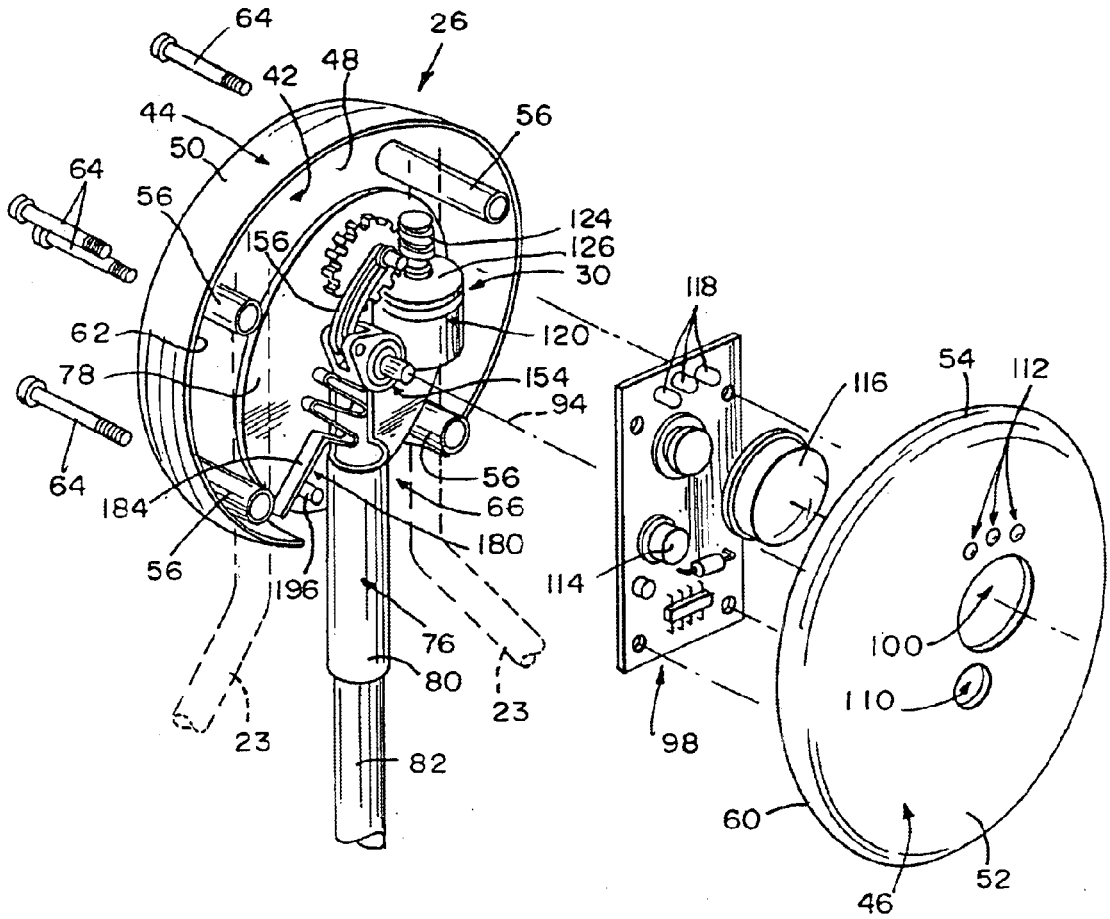
FIG. 2 is an exploded perspective view showing a first piece of a housing at an upper end of the support stand separated away from a second piece of the housing to expose components of a drive assembly situated in the housing.
Figure 3:
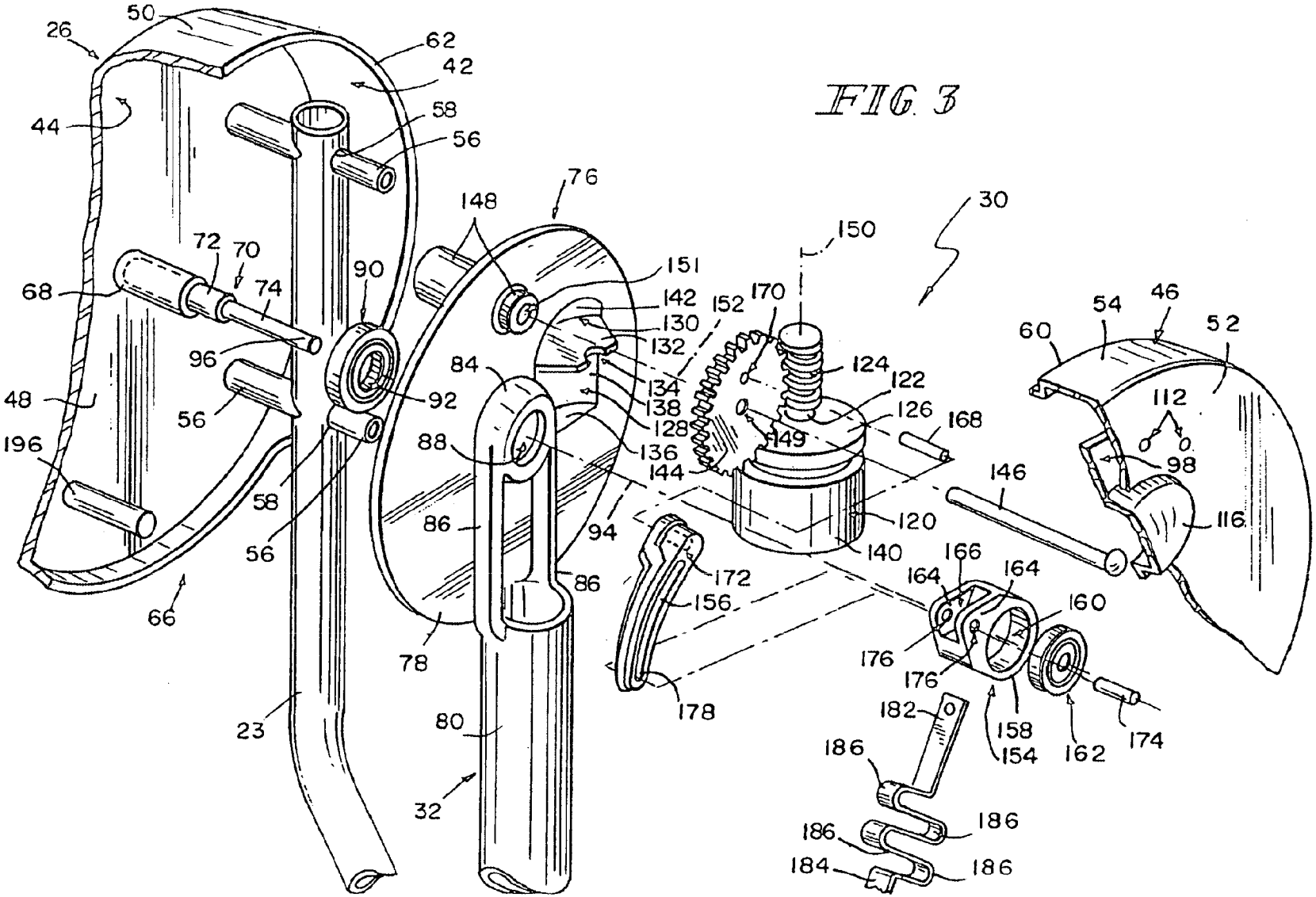
FIG. 3 is an exploded perspective view, with portions broken away, showing an upper end of one of the hanger arms separated away from a horizontal main shaft that extends from the second piece of the housing and showing the drive assembly including a motor that couples to a mounting portion of the hanger arm, a flywheel and worm mounted to an output shaft of the motor, a worm wheel meshed with the worm, a pivot link that couples to the main shaft for pivoting movement, an arcuate connector link that interconnects the worm wheel and the pivot link, and a flexible drive member that extends from the pivot link.
Figure 4:
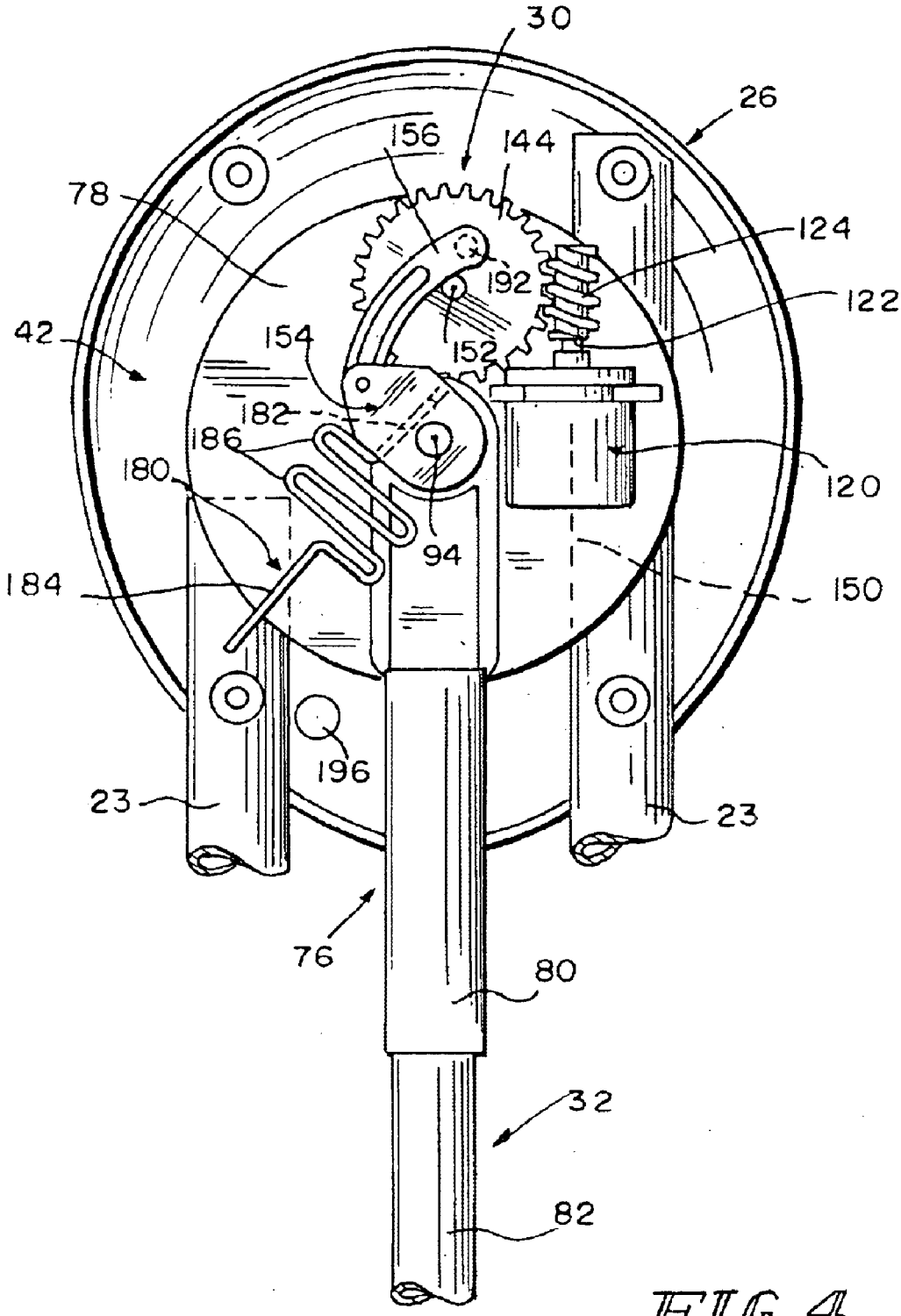
FIG. 4 is a side elevation view of an upper portion of the support stand, one of the hanger arms, and the drive assembly showing a free end region of the flexible drive member that is distal from the pivot link being spaced apart from a stop that is appended to the housing and that is situated adjacent an elongated portion of the hanger arm which extends downwardly from the mounting portion.
Figure 5:
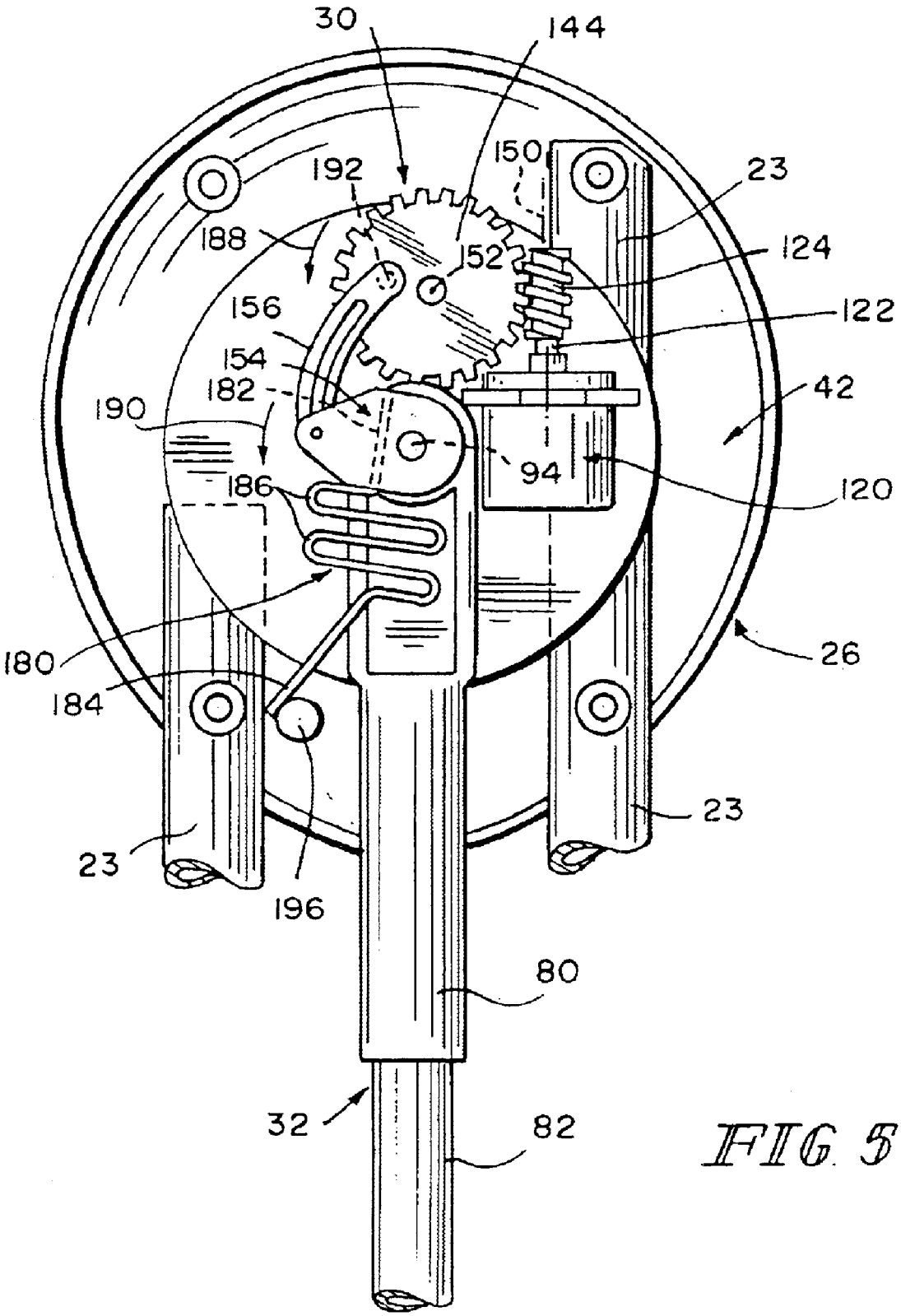
FIG. 5 is a side elevation view, similar to FIG. 4, showing the drive assembly being operated to move the free end region of the flexible drive member into initial contact with the stop that is appended to the housing.
Figure 6:
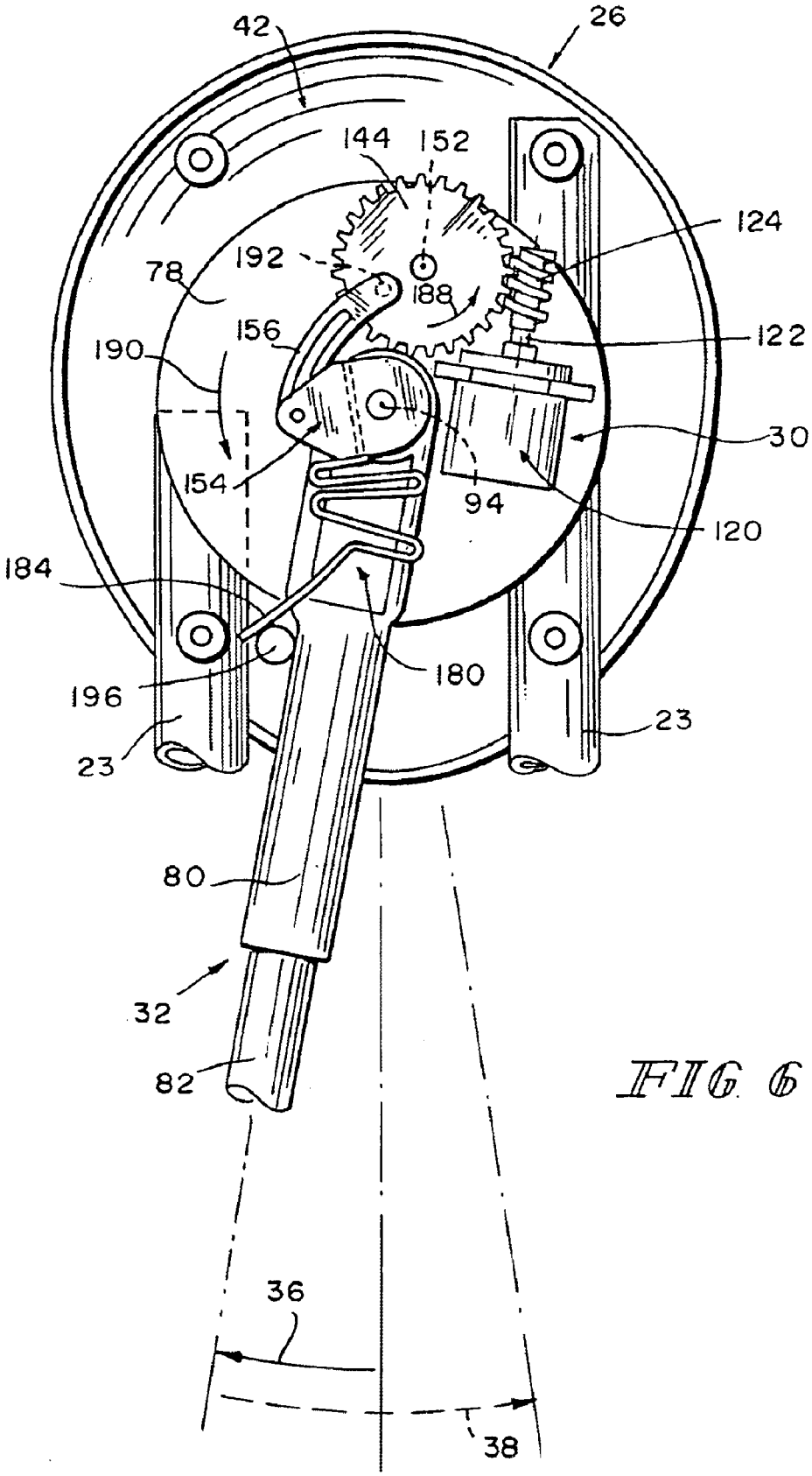
FIG. 6 is a side elevation view, similar to FIG. 5, showing the drive assembly being further operated so that the flexible drive member flexes and imparts a force on the hanger arm through the pivot link, the arcuate connector and the worm wheel which results in the hanger arm moving in a forward swing direction.
Figure 7:
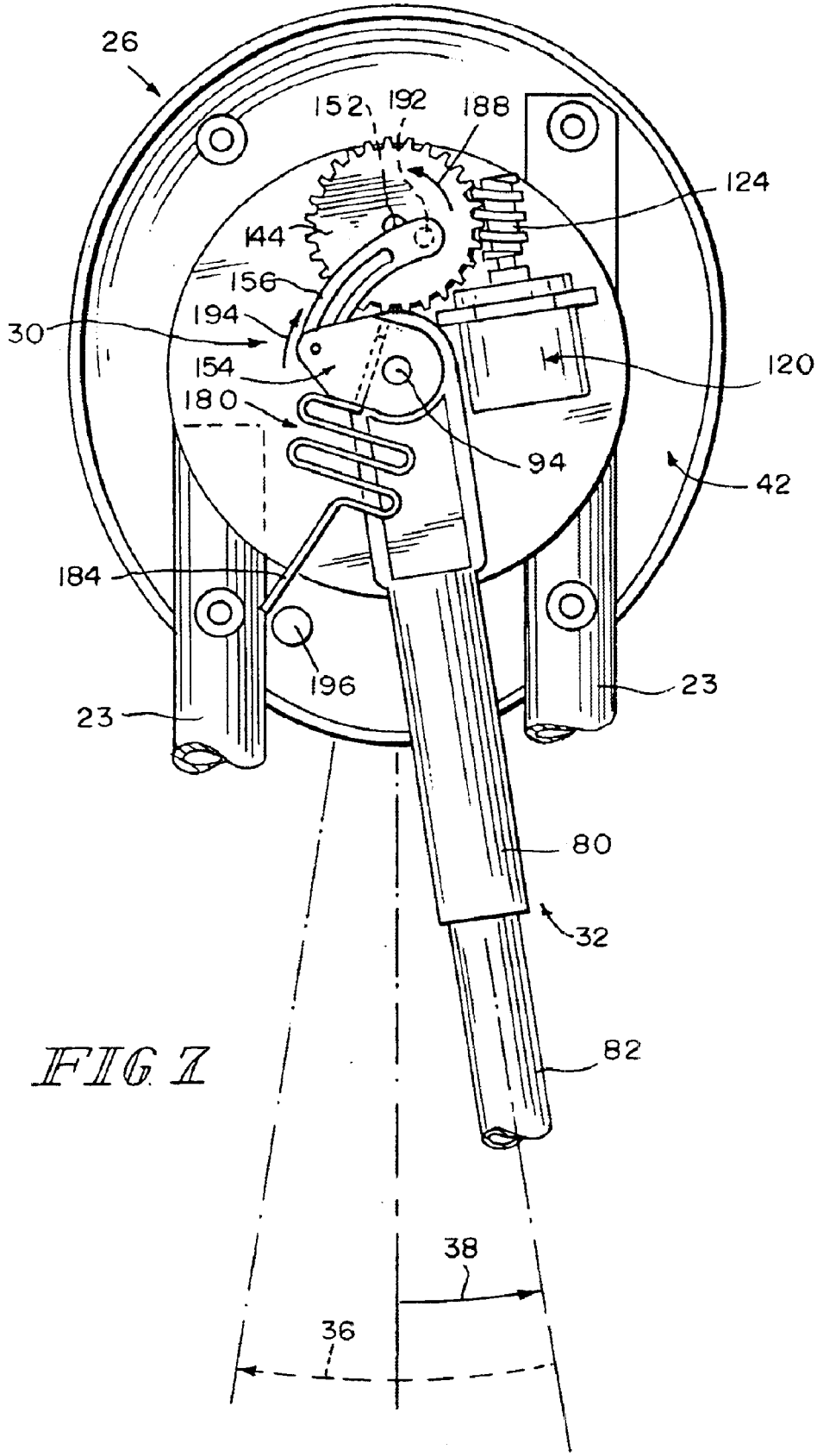
FIG. 7 is a side elevation view, similar to FIG. 6, showing the free end region of the flexible drive member, once again, spaced apart from the stop appended to the housing and showing the hanger arm moving in a backswing direction.

First housing 26 has an interior region 42 in which components of a drive assembly 30 of swing apparatus 20 are situated as shown in FIGS. 2–7. Apparatus 20 comprises a pair of hanger arms 32 and a seat 34 coupled to hanger arms 32. Seat 34 is configured to support an infant or toddler (not shown). One of hanger arms 32 is pivotably coupled to first housing 26 and the other of hanger arms 32 is pivotably coupled to second housing 28. When drive assembly 30 is turned off, swing 24 naturally comes to rest in a neutral position as shown in FIGS. 1 and 4. Operation of drive assembly 30 causes swing 14 to oscillate back and forth between forward and rearward extreme positions. Thus, during operation of drive assembly 30, swing 24 moves alternately in a forward swing direction, indicated by an arrow 36 shown in FIGS. 6 and 7 (arrow 36 is dashed in FIG. 7), and a back swing direction, indicated by an arrow 38 shown in FIGS. 6 and 7 (arrow 38 is dashed in FIG. 6).

Illustrative housing 26 comprises a first piece or shell 44 and a second piece or shell 46 as shown best in FIG. 2. Shell 44 is larger than shell 46 and therefore, shell 44 defines a larger portion of interior region 42 than shell 46. Shell 44 has a generally vertical back wall 48 and a perimeter flange or wall 50 extending away from back wall 48 toward shell 46. Wall 50 blends smoothly with wall 48 such that a rounded edge is formed at the intersection of walls 48, 50. Shell 46 has a generally vertical front wall 52 and a perimeter flange or wall 54 extending away from front wall 52 toward shell 44. Wall 54 blends smoothly with wall 52 such that a rounded edge is formed at the intersection of walls 52, 54. When viewed from the side of apparatus 20 the overall shape of housing 26 is ovoid. The size and shape of housing 28 is substantially the same as the size and shape of housing 26. Housings 26, 28 may, however, be formed in any desired shape according to this disclosure. Furthermore, although illustrative housings 26, 28 are constructed from two pieces 44, 46, support stand 22 may include similar housings constructed from more than two pieces.

Shell 44 includes four cylindrical bosses 56 that extend horizontally from back wall 48 into interior region 42 of housing 26. Shell 46 has cylindrical bosses (not shown) that extend horizontally from front wall 52 into interior region 42 and that are aligned with bosses 56. Bosses 56 each have a large-diameter proximal portion that is appended to back wall 48 and a small-diameter distal portion that projects from the respective large-diameter portion. The upper end region of one of struts 23, which is a non-pivoting strut 23, has a pair of apertures 58 which are sized to receive therein associated small-diameter portions of bosses 56 as shown in FIG. 3. The upper end region of the other of struts 23, which is a pivoting strut 23, has an aperture 59 which is sized to receive therein the small-diameter portion of the associated boss 56. The pivoting strut 23 pivots about the associated boss 56 during folding of stand 22 between the use and storage positions. Annular shoulders (not shown) defined between the small-diameter and large-diameter portions of bosses 56 abut struts 23.

The cylindrical bosses extending from front wall 52 slip over the end regions of the small-diameter portions of bosses 56 that are exposed beyond struts 23. Stand 22 is configured so that when the distal end edges of the bosses extending from wall 52 abut struts 23, an end edge 60 of wall 54 abuts an end edge 62 of wall 50 or, alternatively, is in close proximity to end edge 62 with a minimal amount of clearance therebetween. A set of bolts 64 is provided for coupling shells 44, 46 together. Bolts 64 are received by respective bosses 56 that extend from wall 48 and the companion bosses that extend from wall 52. The threaded end of bolts 64 thread into the bosses extending from wall 52 and bosses 56 have internal shoulders that are engaged by the respective heads of bolts 64. When shells 44, 46 are bolted together, struts 23 are trapped between the large diameter portions of bosses 56 and the bosses extending from wall 52.

The bottom portion of perimeter wall 50 has a fairly large notch 66 formed therein as shown in FIGS. 2 and 3. The bottom portion of perimeter wall 54 has a notch similar to, but not as deep as, notch 66. Notch 66 in wall 50 cooperates with the notch in wall 54 to form a large opening through which struts 23 extend into interior region 42 of housing 26 and within which one of hanger arms 32 swings back and forth during oscillation of swing 24 by drive assembly 30. Struts 23 are situated adjacent the ends of the large opening formed in housing 26 by the notches in walls 50, 54. Shell 44 also has a main cylindrical boss 68 extending horizontally from a central region of back wall 48 as shown in FIG. 3. Apparatus 20 has a main shaft 70 including a large-diameter portion 72 that is received in boss 68 and a small-diameter portion 74 that extends away from portion 72.

The hanger arm 32 that is coupled to housing 26 for pivoting movement comprises a mount 76 having a first mounting portion 78 in the form of a round plate (sometimes referred to herein as "plate 78") and a second mounting portion 80 in the form of a socket (sometimes referred to herein as "socket 80"). The hanger arm 32 associated with housing 26 further comprises a generally L-shaped strut 82 which has an upper portion received in and coupled to socket 80 and which has a lower portion coupled to seat 34. Mounting portion 80 and strut 82 are considered to be an elongated portion of hanger arm 32 which extends from mounting portion 78. In some alternative embodiments, strut 82 may be formed integrally with mount 76. In other alternative embodiments, strut 82 may be formed from multiple segments that couple together. In such embodiments having multiple segments, one or which is coupled to mounting portion 80 of mount 76, these multiple segments and portion 80 are considered to be an elongated portion of the hanger arm. Furthermore, strut 82 may have shapes other than the illustrative L-shape. Thus, strut 82 may be straight, arcuate, J-shaped, or any other desired shape.

Illustrative mount 76 has a hub 84 appended to the central region of plate 78 and a pair of reinforcement ribs 86 extending along plate 78 between hub 84 and socket 80 as shown in FIG. 3. Hub 84 has a shaft-receiving aperture 88 and a bearing-receiving bore (not shown) that is sized to receive the outer race of a bearing 90. An inner race of bearing 90 has a bore 92 that receives portion 72 of shaft 70. Thus, bearing 90 couples mount 76 of hanger arm 32 to shaft 70 for pivoting movement about a pivot axis 94. Shell 46 has a main cylindrical boss (not shown) that is aligned with boss 68 and that receives an end region 96 of portion 74 of shaft 70 to provide added support for shaft 70 relative to housing 26.

As will be discussed in further detail below, certain components of drive assembly 30 are coupled to mounting portion 78 of mount 76 to pivot therewith about pivot axis 94 during the oscillation of swing 24. Drive assembly 30 has a circuit board 98 that carries various electric circuit components which serve as a controller for drive assembly 30. Circuit board 98 is mounted to shell 46 by suitable fasteners, such as bolts (not shown), and therefore, circuit board 98 does not pivot during oscillation of swing 24. Wall 52 of shell 46 has a large aperture 100, a medium-sized aperture 110, and three small apertures 112 as shown in FIG. 2. A main control button 114 is received in aperture 110 and a music button 116 is received in aperture 100. Light emitting diodes (LED's) 118 are received in respective apertures 112.

Successive presses of button 114 by a user will turn drive assembly 30 on at a slow speed, then on at an intermediate speed, then on at a fast speed, and then off, alternately. Thus, successive presses of button 116 by the user will change the speed at which drive assembly 30 operates and will cause associated ones of the LED's 118 to be lit to provide a visual indication of the speed setting of drive assembly 30. Successive presses of button 116 by a user will cause music, which is stored in one or more memory devices of circuit board 98, to be turned on and off, alternately. In some embodiments, multiple songs are stored in the memory devices of circuit board 98 and successive presses of button 116 will scroll through the various songs before turning the music is turned off. Circuit board 98, therefore, has a speaker or similar sound-producing device through which the music is played.

Housing 28 and the hanger arm 32 associated with housing 28 are substantially the same, but mirror images of, housing 26 and the hanger arm 32 associated with housing 26. Thus, the description above of housing 26 and its associated hanger arm 32 is also applicable to housing 28 and its associated hanger arm 32 with a couple of notable exceptions. One notable exception is that no drive assembly is present in the interior region of housing 28. Thus, mount 76 associated with housing 28 optionally may omit plate 78 because there are no components of a drive assembly to be coupled to this mount 76. In addition, no apertures (like apertures 100, 110, 112) are provided in housing 28 because there is no circuit board with associated buttons and LED's in the interior region of housing 28.

Drive assembly 30 is situated in interior region 42 of housing 26 as mentioned above. Drive assembly 30 comprises a driver, which illustratively is an electric motor 120 having an output shaft 122. Drive assembly 30 also has a worm 124 mounted on an end of output shaft 122 and a flywheel 126 mounted on output shaft 122 between worm 124 and the main portion of motor 122 as shown in FIGS. 3–7. Plate 78 has a motor-receiving recess 128 and a flywheel-receiving recess 130 as shown in FIG. 3. A partition 132 separates recess 128 from recess 130. A shaft-receiving notch 134 is formed in an outer edge of partition 132 as also shown in FIG. 3. Motor 120 is coupled to plate 78 via suitable fasteners (not shown), such as bolts, clips, straps, fingers, bands, or the like.

Recess 128 is bounded by partition 132, a bottom wall 136 and a sidewall 138 as shown in FIG. 3. A bottom of motor 120 rests upon bottom wall 136 and a portion of an outer wall 140 of motor 120 abuts sidewall 138 when motor 120 is mounted to plate 78. Sidewall 138 is complimentary to the shape of outer wall 140, which in the illustrative embodiment is substantially cylindrical. Recess 130 is bounded by partition 132, a top wall (not shown), and a sidewall 142. Flywheel 126 is situated partially within recess 130 but is spaced from partition 132, the associated top wall, and sidewall 142 by a slight amount so that flywheel 126 may rotate without interference from these portions of mount 76. A portion of shaft 122 which is exposed between motor 120 and flywheel 126 is received in notch 134.

A set of wires (not shown) extends between circuit board 98 and motor 120 with enough slack to permit oscillation of motor 120 about axis 94 along with mount 76. Power to operate motor 120 at the selected speed is applied to motor 120 via the set of wires. A suitable power source, such as a set of batteries (D-cell batteries, for example) is situated in interior region 42 of housing 26. Power from the power source is used to operate motor 120 and to operate certain circuit components (such as integrated circuit chips and LED's 118) of circuit board 98. Circuit board 98 has appropriate circuitry for controlling the voltage applied to motor 120 from the power source. Thus, the speed at which motor 120 operates is adjusted by adjusting the voltage applied to motor 120.

Drive assembly 30 further comprises a worm wheel 144 that is pivotably coupled by a pivot pin 146 to a cylindrical boss 148 appended to plate 78. A first portion of boss 148 extends from plate 78 toward worm wheel 144 and a second portion of boss 148 extends from plate 78 toward back wall 48 of shell 44 as shown in FIG. 3. Pin 146 extends through a central aperture 149 formed in worm wheel 144 and into a bore 152 formed in boss 148. Worm wheel 144 is meshed with worm 124 so that rotation of worm 124 about an axis 150 that is orthogonal to axis 94 results in rotation of worm wheel 144 about a wheel axis 152 that is parallel with axis 94.

Drive assembly also comprises a pivot link 154 and a connector 156. Illustrative connector 156 comprises an arcuate link (sometimes referred to herein as "link 156"). Pivot link 154 has a bearing-receiving portion 158 with a bore 160 that is sized and configured to receive an outer race of a bearing 162. An inner race of bearing 162 is sized for receipt of portion 74 of shaft 70. Thus, bearing 162 couples pivot link 154 to shaft 70 for pivoting movement about axis 94, which is the same axis 94 about which swing 24 pivots. Pivot link 154 also has a pair of arms or flanges 164 that extend from portion 158 and that are spaced apart to define a connector-receiving space 166 therebetween as shown in FIG. 3.

An upper end of link 156 is pivotably coupled to worm wheel 144 by a pivot pin 168 which is received, in part, in an aperture 170 formed in worm wheel 144 and which is received, in part, in a bore 172 formed in the upper end of link 156. Aperture 170 is offset radially from central aperture 149 so that, as worm wheel 144 rotates about axis 152, pin 168 orbits around axis 152. A lower end of link 156 is pivotably coupled to flanges 164 of pivot link 154 by a pivot pin 174. End regions of pin 174 are received in apertures 176 formed near the distal ends of flanges 164 and a middle region of pin 174 is received in an aperture 178 formed in the lower end of link 156. Thus, the lower end of link 156 is received in space 166 and is trapped between flanges 164. As worm wheel 144 rotates about axis 152 causing pin 168 and the upper end of link 156 to orbit about axis 152, the lower end of link 156 acts through pin 174 to oscillate pivot link 154 back and forth about axis 94.

Drive assembly 30 comprises a drive member 180 that extends from pivot link 154. Drive member 180 has a proximal end region 182 that is coupled to link 154 by one or more suitable fasteners (not shown), such as pins, bolts, screws, rivets, tabs, fingers, snaps, adhesive, welds, or the like, to link 154. Drive member 180 also has a free or distal end region 184 that is spaced from proximal end region 182. In the illustrative embodiment, drive member 180 is flexible and comprises a zigzag spring which has several undulations 186 that interconnect end regions 182, 184. In alternative embodiments, other types of drive members, such as one or more leaf springs, torsion springs, or spring-loaded rigid members, may be provided in drive assembly 30 in lieu of illustrative zigzag spring 180 so long as these alternative drive members have suitable spring constants and/or flexing characteristics for moving swing 24 in a desired manner. Drive member 180 is driven by driver 120. In particular, motor 120 oscillates member 180 about axis 94 through a drive train of assembly 30 which drive train is provided by worm 124, worm gear 144, connector 156, and pivot link 154.

When drive assembly 30 is turned off and swing 24 is in the neutral position, drive assembly 30 may be in an arbitrary stationary position such as the one shown in FIG. 4 in which free end region 184 of drive member 180 is spaced apart from the stop 196. When drive assembly 30 is turned on, motor 120 rotates worm 124 about axis 150 which, in turn, causes worm wheel 144 to rotate about axis 152 in a counterclockwise direction indicated by arrow 188 in FIG. 5. In the illustrative example, as worm wheel 144 rotates in direction 188, connector 156 pushes pivot link 154 to rotate pivot link 154 in a counterclockwise direction indicated by arrow 190 in FIG. 5. As pivot link 154 moves about axis 94 in direction 190, distal end region 184 of drive member 180 eventually engages a stop 196 causing member 180 to flex. Stop 196 is appended to back wall 48 of housing piece 44 and projects therefrom in a cantilevered manner. Illustrative stop 196 is cylindrical and is formed integrally with wall 48. Alternative stops may have shapes other than cylindrical and may comprise a separate element that attaches to some portion of housing 26. Like stop 196, these alternative stops arc considered to be part of support stand 22.

As member 180 flexes due to engagement with stop 196, a force is imparted on pivot link 154 by member 180 to counteract or retard the pivoting movement of link 154, thereby to counteract or retard the ability of connector 156 to move pivot link 154 which, in turn, attempts to counteract or retard the ability of worm wheel 144 to move connector 156. However, worm wheel 144 is meshed with worm 124 which is being rotated by motor 120 at a predetermined speed as dictated by the speed setting of motor 120 selected by the user. Thus, the force imparted on worm wheel 144 by drive member 180, through links 154, 156, is transmitted to mount 76 of hanger arm 32 through pin 146 which causes swing 24 to pivot about axis 94 in forward swing direction 36.

While drive member 180 is flexed due to contact with stop 196, a driving force is imparted by member 180 on hanger arm 32 via the drive train of drive assembly 30 to move swing 24 in forward swing direction 36. An axis 192 about which connector 156 pivots relative to worm wheel 144 is defined by pivot pin 168. Continued rotation of worm wheel 144 in direction 188 from the position shown in FIG. 6, causes axis 192 to pass through a plane defined between axes 94, 152 at which point pivot link 154 reverses its direction of motion so as to pivot about axis 94 in a clockwise direction indicated by arrow 194 in FIG. 7. The position of drive assembly shown in FIG. 7 occurs after worm wheel 144 has rotated axis 192 about axis 152 several degrees past the plane defined between axes 94, 152. As pivot link 154 pivots about axis 94 in direction 194, the amount of flexure of drive member 180 first decreases and then drive member 180 separates away from stop 196 and returns to its original shape.

Depending upon the weight of swing 24, the load carried by swing 24, and the duration and magnitude of the force imparted on swing 24 by drive member 180, swing 24 will move in forward swing direction 36 by some certain angular displacement (up to the maximum angular displacement determined by strut 82 contacting one of frame members 23 or some other portion of stand 22) and then swing 24 will start swinging in back swing direction 38. Swing 24 will move in back swing direction 38 by some certain angular displacement (up to the maximum angular displacement determined by strut 82 contacting the other of frame members 23 or some other portion of stand 22) and then, at some point during motion of swing 24 in either direction 38 or direction 36, drive member 180 will, once again, contact stop 196 of housing 26 to impart a force on swing 24 to push swing 24 in forward swing direction 36.

In the illustrative embodiment, motor 120 is operable at three different speeds as mentioned above. The frequency of oscillation of hanger arm 32 and seat 34 is sped up or slowed down by adjusting the speed of motor 120. It has been found that swing 24 naturally tends toward a resonant frequency depending upon the speed of motor 120 and other factors, such as the amount of weight being oscillated. In order to reach the resonant frequency of oscillation, the swing amplitude (i.e., the extent of angular movement of swing 24 measured from the first extreme position to the second extreme position) typically will change as the motor speed changes or as the amount of weight being oscillated changes.

If for some reason, swing 24 is prevented from swinging in either forward swing direction 36 or back swing direction 38 or both, drive assembly 30 is still able to operate as usual having drive member 180 periodically engaging stop 196 and flexing to impart a force on swing 24 with no resulting movement of swing 24. Thus, the flexibility of drive member 180 provides drive assembly 30 with a lost motion connection so that no components of apparatus 20 are damaged if swing 24 is unable to oscillate about axis 94.

Based on the foregoing discussion, it should be understood that drive assembly 30 is coupled to hanger arm 32 to pivot therewith about axis 94, which is the same axis that hanger arm 32 and seat 34 pivot about relative to stand 22. Thus, the weight of drive assembly 30 contributes to the overall inertia of the swinging mass which enhances the smoothness of swinging motion because the occupant of scat 24 will be less likely to "feel" the contact and release of drive member 180 from stop 196. In addition, the drive assembly 30 is self-starting in that a user does not need to push swing 24 to start the swinging motion of swing 24. The self-starting torque is generated by drive member 180 contacting stop 196 of stand 22. Thus, drive member 180 "pushes off" of stand 22 during operation of apparatus 20. In addition, apparatus 20 has been found to be quieter in operation than some other swings which have motors fixed relative to the associated stands. This is believed to be due to motor vibrations being dissipated or attenuated in the swinging masses of apparatus 20 rather than vibrating the associated housing which may act as an echo chamber.

Referring now to FIGS. 8–13, an alternative support stand 222 has an alternative housing 226 in which an alternative drive assembly 230 is situated. Stand 222, housing 226, and drive assembly 230 are substantially similar to stand 22, housing 26, and drive assembly 30. Therefore, like reference numerals arc used to denote portions of stand 222, housing 226, and drive assembly 230 that are substantially the same as like components of stand 22, housing 26, and drive assembly 30. Housing 226 is coupled to upper portions of frame members 23 and has an interior region 42 in which drive assembly 230 is situated.

Figure 8:
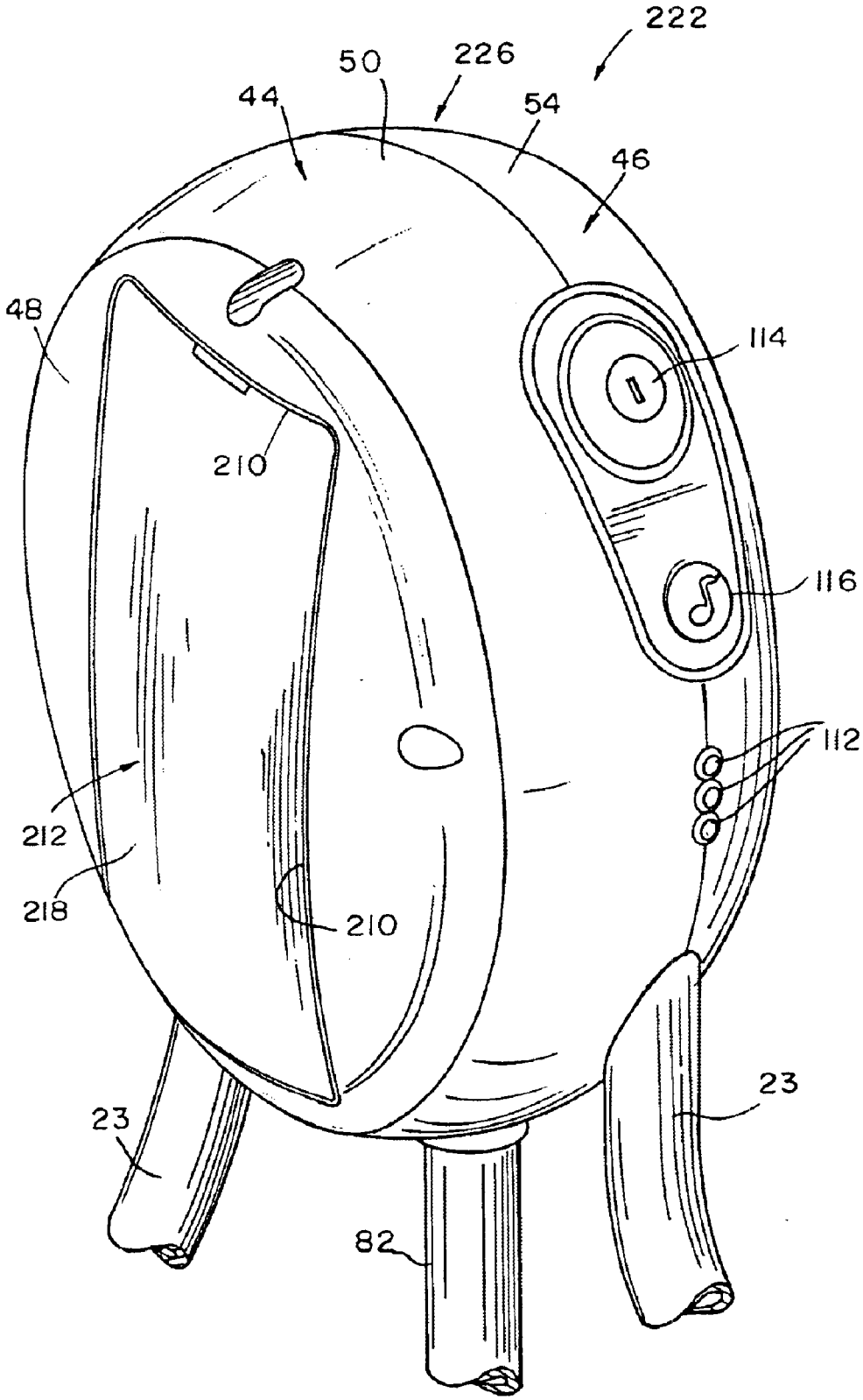
FIG. 8 is a perspective view showing a portion of an alternative support stand having an alternative housing in which an alternative drive assembly is situated, a back wall of the alternative housing having a somewhat rectangular battery door, control buttons of the alternative drive assembly being accessible on an outer wall of the alternative housing, and a set of speed indicators being situated beneath the control buttons.
Figure 9:
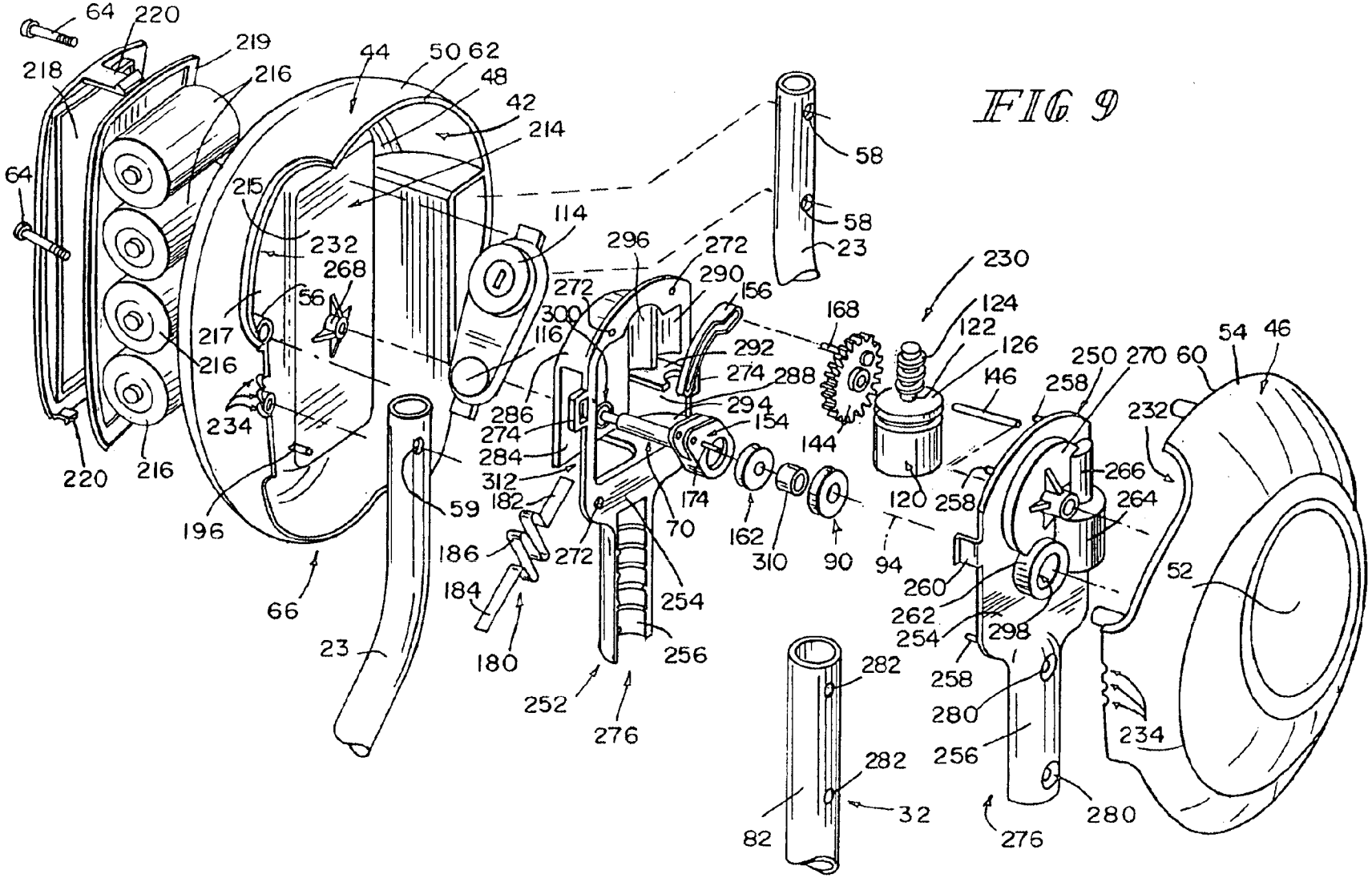
FIG. 9 is an exploded perspective view of the alternative housing of FIG. 8 showing a first piece of the housing separated away from a second piece of the housing to expose components of the alternative drive assembly situated in the housing, the battery door separated away from the first piece of the housing, and four D-cell batteries arranged between the battery door and a battery-receiving compartment formed in the first piece of the housing.
Figure 10:
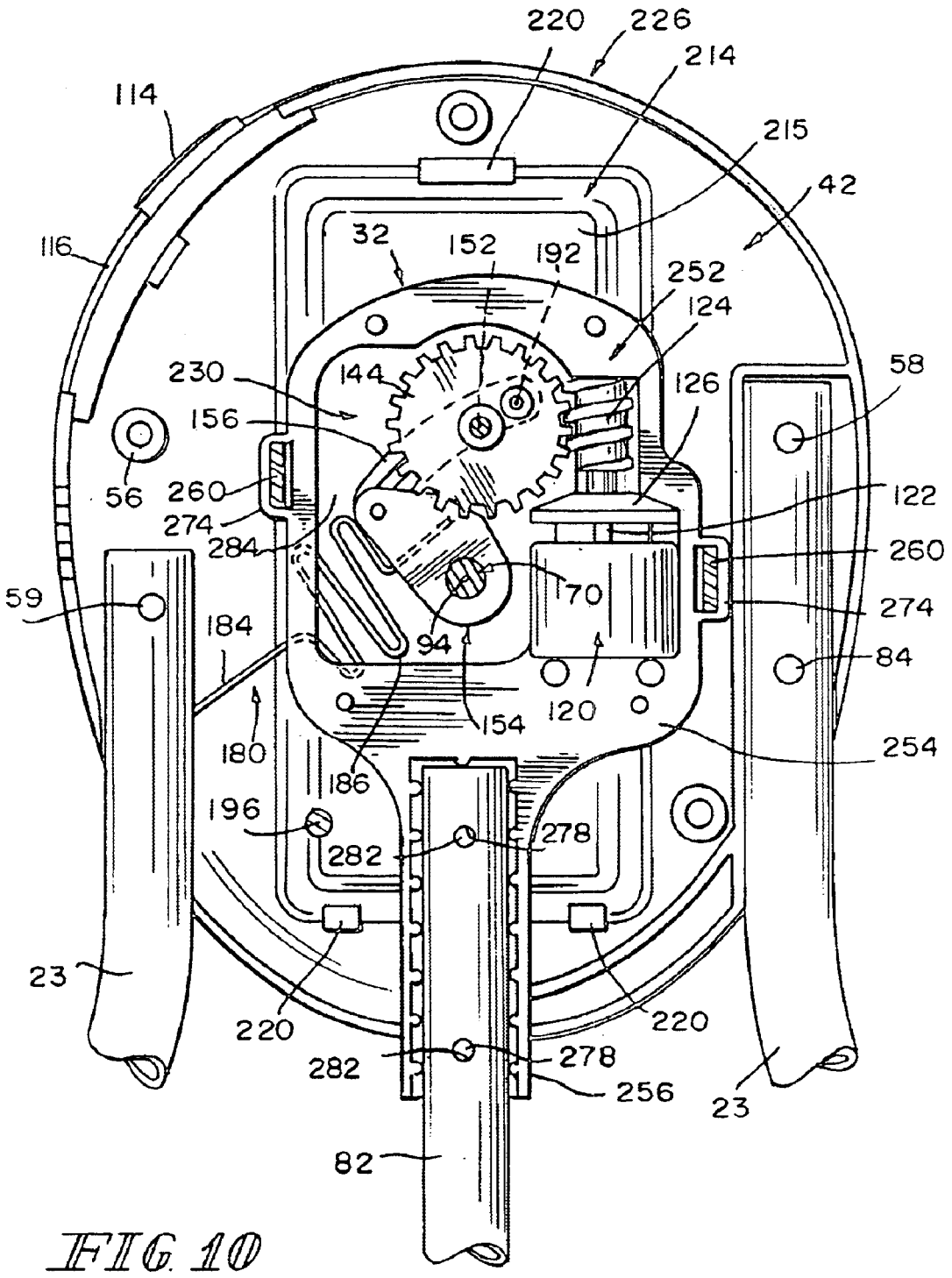
FIG. 10 is a side elevation view of the alternative drive assembly showing a free end region of a flexible drive member that is distal from a pivot link being spaced apart from a stop that is appended to the housing and that is situated adjacent an elongated portion of the hanger arm which extends downwardly from the mounting portion.
Figure 11:
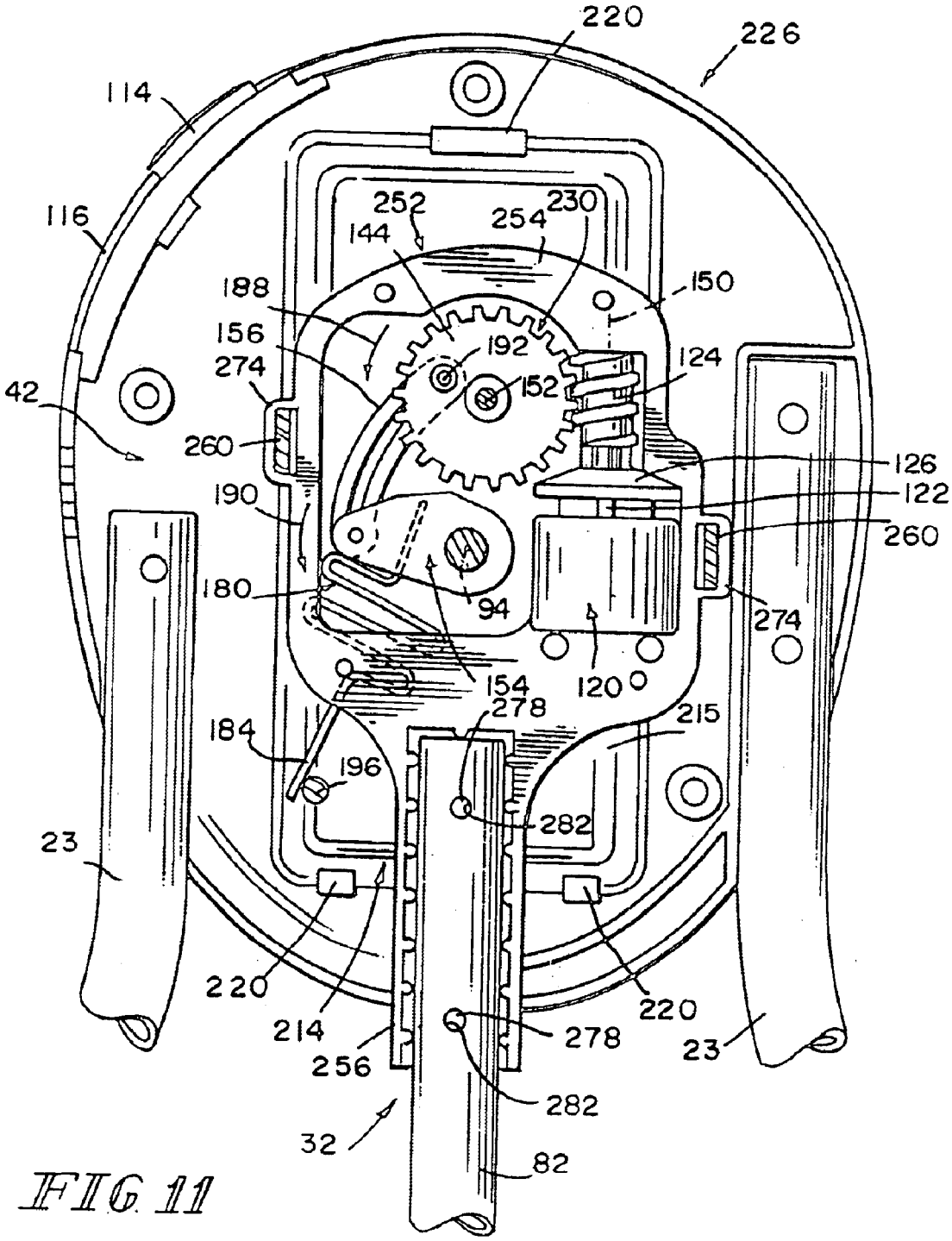
FIG. 11 is a side elevation view, similar to FIG. 10, showing the drive assembly being operated to move the free end region of the flexible drive member into initial contact with the stop that is appended to the housing.

Back wall 48 of shell 44 of housing 226 has a substantially rectangular opening 210 and a battery cover 212 that is received in the opening 210 as shown in FIG. 8. A battery compartment 214, shown in FIG. 9, is appended to back wall 48 and projects therefrom into interior region 42 of housing 226. Compartment 214 is sized and configured for receipt of four D-cell batteries 216 which provide power for a circuit board (not shown) of drive assembly 230. In some embodiments, the circuit board of drive assembly 230 may be housed within the battery compartment and in other embodiments, the circuit board of drive assembly 230 is situated in some other portion of interior region 42. Cover 212 has a main wall 218 and a set of fingers 220, at least one of which is a flexible finger 220, extending from main wall 218. Compartment 214 has openings or notches in which portions of fingers 220 are received to couple cover 212 to the remainder of housing 226. A gasket 219 made of vibration dampening material, such as foam rubber, is interposed between cover 212 and compartment 214 of shell 44.

Control button 114, music button 116, and LED's 118 of drive assembly 230 are situated along the seam defined between shells 44,46 of housing 226 as shown best in FIG. 8. Edge 62 of wall 50 of shell 44 and edge 60 of wall 54 of shell 46 are each formed to include a button-receiving notch 232 and three LED-receiving notches 234 as shown in FIG. 9. When shells 44, 46 of housing 226 are coupled together, notches 232 cooperate to form a large opening in which buttons 114, 116 are received and notches 234 cooperate to form three small openings in which respective LED's 118 are received. Buttons 114, 116 and LED's 118 are located on a forwardly facing portion of housing 226.

A boss 268 is appended to a central region of a back wall 215 of battery compartment 214 as shown in FIG. 9. A small-diameter end (not shown) of main shaft 70 is received in boss 268. Another boss (not shown) is appended to front wall 52 and an opposite end of shaft 70 is received in this boss. Thus, shaft 70 is supported in a horizontal orientation and is situated in interior region 42 of housing 226 between back wall 215 of compartment 214 and front wall 52 of shell 46. Shaft 70 defines axis 94 about which the associated hanger arm 32 pivots and about which pivot link 154 of drive assembly 230 pivots. Stop 196 against which drive member 180 acts to oscillate swing 24 supported by stand 222, is appended to and projects from a rounded comer region defined at the junction of back wall 215 and a side wall 217 of battery compartment 214 as shown in FIG. 9.

The hanger arm 32 supported for rotation relative to housing 226 comprises an alternative mount 276 to which strut 82 couples as shown in FIG. 9. Mount 276 comprises a first piece or shell 250 and a second piece or shell 252. Shells 250, 252 are configured to encase a majority of drive assembly 230 therebetween. Shell 250 has a main vertical wall 254 and a strut-receiving portion 256 extending downwardly from wall 254. A set of orientation pins 258 and a pair of flexible snap fingers 260 extend horizontally from wall 254 toward shell 252. Shell 250 also has a bearing-receiving portion 262, a motor-receiving portion 264, a worm-receiving portion 266, and a gear-receiving portion 270, each of which is appended to wall 254. Portions 262, 264, 266, 270 are contoured so as to define cavities of the appropriate shape to receive corresponding portions of drive assembly 230 therein.

As was the case with shell 250, shell 252 also has a main vertical wall 254 and a strut-receiving portion 256 extending downwardly from wall 254. Wall 254 of shell 252 has a set of pin-receiving apertures 272 and a pair of eyelets 274. When shells 250, 252 are coupled together, pins 258 are received in apertures 272 and fingers 260 are received in eyelets 274. Fingers 260 flex inwardly toward the center of mount 276 when being inserted through eyelets 274 and once the enlarged end portions of fingers 260 pass all the way through eyelets 274, fingers 260 flex outwardly away from the center of mount 276 so that the enlarged end portions of fingers 260 cooperate with eyelets 274 to prevent shells 250, 252 from separating. When shells 250, 252 are coupled together, strut-receiving portions 254 cooperate to from a generally cylindrical bore in which an upper end of strut 82 is received. Suitable fasteners 278 (see FIG. 10, for example), such as bolts or rivets, extend through respective apertures 280 formed in portions 256 and through respective apertures 282 formed in strut 82 to couple strut 82 to mount 276.

Shell 252 has a vertical back wall 284 that is spaced from and parallel with the associated wall 254 and an arcuate top wall 286 that interconnects walls 254, 284 as shown in FIG. 9. Shell 252 also has a motor-receiving portion 288 and a worm-receiving portion 290. A partition 292 separates portions 288, 290 and a bottom wall 294 underlies portion 288. Shell 252 also has a vertical wall 296 hanging downwardly from top wall 286 adjacent portion 290. Shaft 70 extends through an aperture 298 formed in portion 262 of shell 250 and through an aperture 300 formed in wall 284 of shell 252. Bearing 90 is received in the cavity defined by portion 262 of shell 250 and supports mount 276 and the rest of the associated hanger arm 32 for pivoting movement about axis 94. Bearing 162 supports pivot link 154 on shaft 70 in the space defined between walls 254, 284 of shell 252. A sleeve bushing 310 is mounted on shaft 70 between bearings 90, 162 and serves as a spacer.

Most of drive assembly 230 is encased between shells 250, 252 of mount 276 as mentioned above. In particular, motor 120, the output shaft 122, worm 124, flywheel 126, gear 144, pivot link 154, and connector 156 are all encased by mount 276, as are the various elements that couple the drive train together. However, drive element 180 extends from pivot link 154 through a slot or opening 312 defined in shell 252 between walls 254,284 of shell 252 so that, as pivot link 154 oscillates about axis 94 during operation of drive assembly 230, distal end portion 184 of drive element 180 is able to periodically engage stop 196 to provide the driving force for oscillating the associated hanger arm 32.

Drive assembly 230 operates substantially the same as drive assembly 30 operates. Thus, when drive assembly 230 is turned off, drive assembly 230 may be in an arbitrary stationary position such as the one shown in FIG. 10 in which free end region 184 of drive member 180 is spaced apart from the stop 196. When drive assembly 230 is turned on, motor 120 rotates worm 124 about axis 150 which, in turn, causes worm wheel 144 to rotate about axis 152 in a counterclockwise direction indicated by arrow 188 in FIG. 11. In the illustrative example, as worm wheel 144 rotates in direction 188, connector 156 pushes pivot link 154 to rotate pivot link 154 in a counterclockwise direction indicated by arrow 190 in FIG. 11. As pivot link 154 moves about axis 94 in direction 190, distal end region 184 of drive member 180 eventually engages stop 196 causing member 180 to flex.

Figure 12:
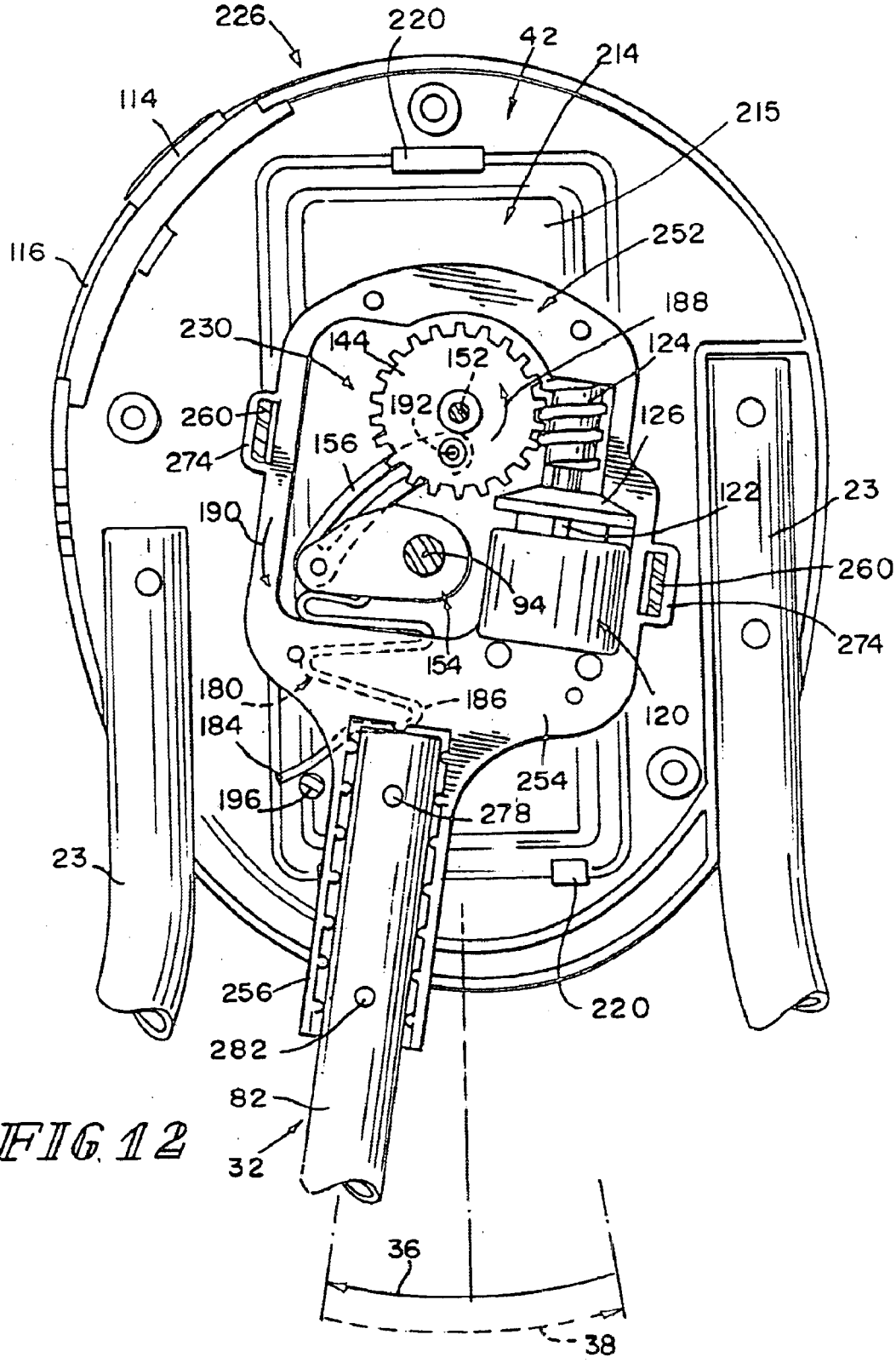
FIG. 12 is a side elevation view, similar to FIG. 11, showing the drive assembly being further operated so that the flexible drive member flexes and imparts a force on the hanger arm through the pivot link, an arcuate connector and a worm wheel which results in the hanger arm moving in a forward swing direction.
Figure 13:
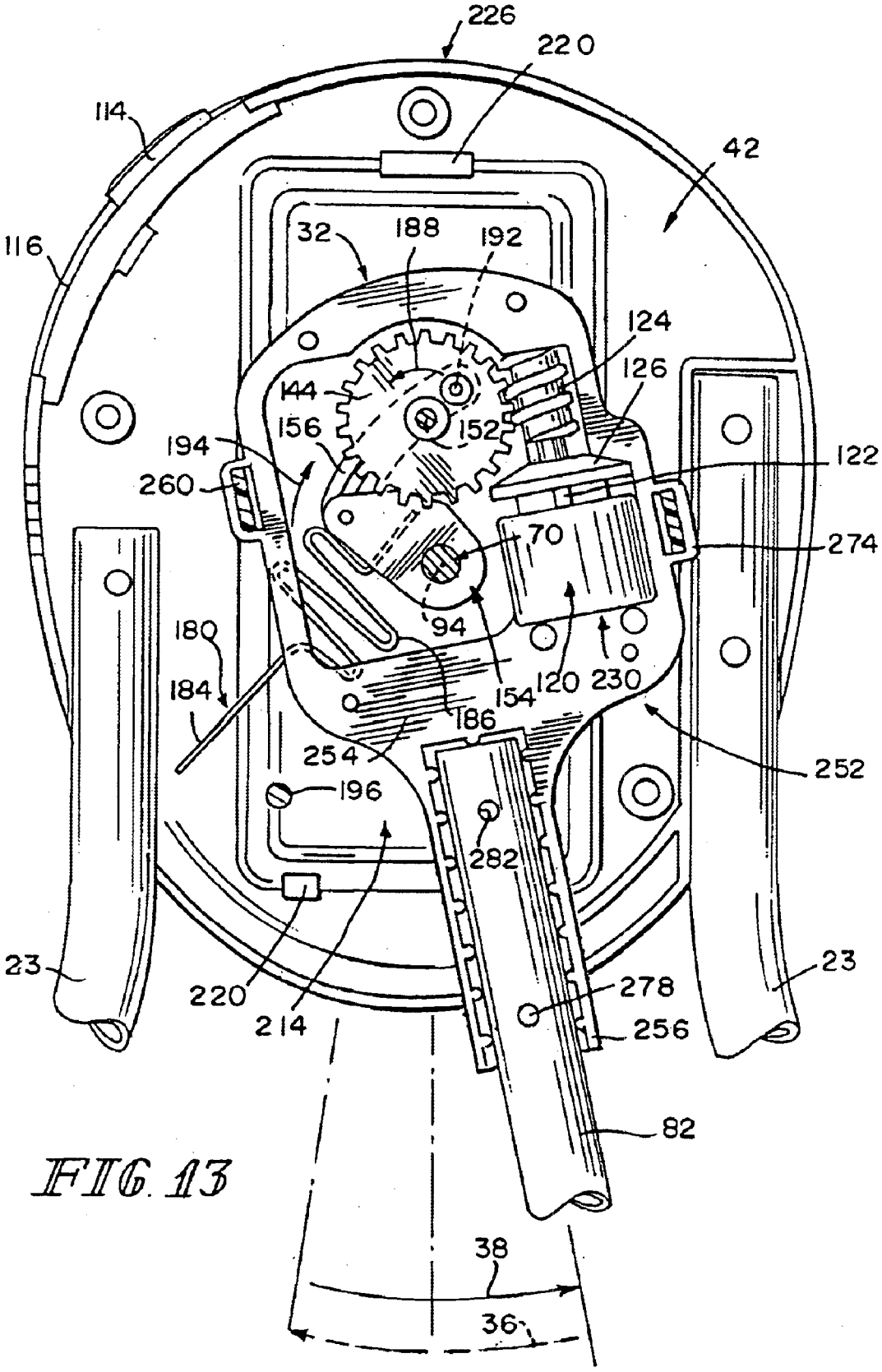
FIG. 13 is a side elevation view, similar to FIG. 12, showing the free end region of the flexible drive member, once again, spaced apart from the stop appended to the housing and showing the hanger arm moving in a backswing direction.

As member 180 flexes due to engagement with stop 196, a force is imparted on pivot link 154 by member 180 to counteract or retard the pivoting movement of link 154, thereby to counteract or retard the ability of connector 156 to move pivot link 154 which, in turn, attempts to counteract or retard the ability of worm wheel 144 to move connector 156. However, worm wheel 144 is meshed with worm 124 which is being rotated by motor 120 at a predetermined speed as dictated by the speed setting of motor 120 selected by the user. Thus, the force imparted on worm wheel 144 by drive member 180, through links 154, 156, is transmitted to mount 276 of hanger arm 32 through pin 146 which causes the associated swing to pivot about axis 94 in forward swing direction 36 as shown in FIG. 12.

While drive member 180 is flexed due to contact with stop 196, a driving force is imparted by member 180 on hanger arm 32 via the drive train of drive assembly 230 to move the associated swing in forward swing direction 36. Continued rotation of worm wheel 144 in direction 188 from the position shown in FIG. 12, causes axis 192 to pass through a plane defined between axes 94, 152 at which point pivot link 154 reverses its direction of motion so as to pivot about axis 94 in a clockwise direction indicated by arrow 194 in FIG. 13. The position of drive assembly 230 shown in FIG. 13 occurs after worm wheel 144 has rotated axis 192 about axis 152 several degrees past the plane defined between axes 94, 152. As pivot link 154 pivots about axis 94 in direction 194, the amount of flexure of drive member 180 first decreases and then drive member 180 separates away from stop 196 and returns to its original shape. After member 180 separates from stop 196, the associated swing will swing in back swing direction 38 until drive member 180, one again, contacts stop 196 to impart a force on the associated swing to push the swing in forward swing direction 36.

Although the disclosure has been described in detail with reference to certain illustrative embodiments, variations and modifications exist within the scope and spirit of the disclosure as described and as defined in the following claims.

What is claimed is:

1. A swing apparatus comprising a support stand having a stop, a swing supported with respect to the support stand to oscillate back and forth along a swing arc about a pivot axis, the swing having a seat and a hanger arm, and a drive assembly having a driver mounted to the hanger arm to oscillate therewith, the drive assembly having a drive member that is driven by the driver and that periodically engages the stop resulting in the member transmitting a force imparting torque on the hanger arm to move the swing.

2. The swing apparatus of claim 1, wherein the drive member is flexible.

3. The swing apparatus of claim 1, wherein the drive member comprises a zigzag spring.

4. The swing apparatus of claim 1, wherein the drive member also oscillates about the pivot axis.

5. The swing apparatus of claim 1, wherein the driver comprises an electric motor that is coupled to the hanger arm to oscillate therewith about the pivot axis.

6. The swing apparatus of claim 5, wherein the electric motor has an output shaft and the drive assembly further comprises a worm mounted to the output shaft, a worm wheel meshed with the worm and coupled to the hanger arm to rotate about a wheel axis that is spaced from the pivot axis, a pivot link to which the drive member is coupled, and a connector that interconnects the worm wheel and the pivot link.

7. The swing apparatus of claim 6, wherein the connector comprises an arcuate link.

8. The swing apparatus of claim 6, wherein the wheel axis is parallel with the pivot axis.

9. The swing apparatus of claim 1, wherein the hanger arm comprises a first mounting portion to which the drive assembly is coupled, an elongated second mounting portion extending from the first mounting portion, and a strut extending between the elongated second mounting portion and the seat.

10. The swing apparatus of claim 1, wherein the support stand comprises a housing and a set of frame members extending from the housing and the portion of the support stand that is periodically engaged by the drive member comprises a stop appended to the housing.

11. A swing apparatus comprising a support stand, a seat, a hanger arm having a mounting portion that is coupled to the support stand, the hanger arm having an elongated portion extending between the mounting portion and the seat, the hanger arm and seat being movable together about a pivot axis, and a drive assembly having a driver mounted to the mounting portion to pivot therewith about the pivot axis, a drive member that engages a portion of the support stand resulting in a force being imparted on the hanger arm to oscillate the hanger arm and the seat about the pivot axis, and a drive train interconnecting the driver and the drive member, the drive train comprising a pivot element that pivots about the pivot axis, the drive member being coupled to and extending from the pivot element.

12. The swing apparatus of claim 11, wherein the drive member comprises a zigzag spring.

13. The swing apparatus of claim 11, wherein the elongated portion of the hanger arm comprises a socket appended to the mounting portion and a strut having a first end portion received in the socket and a second end portion coupled to the seat.

14. The swing apparatus of claim 13, wherein the mounting portion substantially encases both the driver and the drive train and the mounting portion has an opening through which the drive member extends.

15. The swing apparatus of claim 11, wherein the support stand comprises a housing and a set of frame members extending from the housing and the portion of the support stand that is periodically engaged by the drive member comprises a stop appended to the housing.

16. The swing apparatus of claim 11, wherein the speed at which the driver is operable is adjustable to adjust a frequency at which the hanger arm and seat oscillate.

17. The swing apparatus of claim 11, wherein the driver comprises an electric motor and the drive train further comprises a worm that is rotated by the motor, a worm wheel meshed with the worm and coupled to the hanger arm to rotate about a wheel axis that is spaced from the pivot axis, and a connector that interconnects the worm wheel and the pivot element.

18. A swing apparatus comprising a support stand, a swing supported with respect to the support stand to oscillate back and forth along a swing arc about a pivot axis, and means for driving the swing to oscillate about the pivot axis, the means for driving including a member that periodically engages a portion of the support stand whereby the member causes a periodic torque to oscillate the swing about the pivot axis.

19. The swing apparatus of claim 18, wherein the member comprises a zigzag spring.

20. The swing apparatus of claim 18, wherein the means has a pivot element that oscillates about the pivot axis out of phase with the swing, the member has a proximal end region coupled to the pivot element, and the member has a distal end region that is spaced from the pivot element and that periodically engages the support stand to oscillate swing.

* * * * *